US009535388B2

(12) United States Patent
Iwasaka

(10) Patent No.: US 9,535,388 B2
(45) Date of Patent: Jan. 3, 2017

(54) RECORDING MATERIAL TRANSPORTING APPARATUS, AND IMAGE FORMING APPARATUS

(71) Applicant: FUJI XEROX CO., LTD., Tokyo (JP)

(72) Inventor: Akira Iwasaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/510,424

(22) Filed: Oct. 9, 2014

(65) Prior Publication Data

US 2015/0277331 A1 Oct. 1, 2015

(30) Foreign Application Priority Data

Mar. 26, 2014 (JP) ..... 2014-064741

(51) Int. Cl.
*G03G 15/00* (2006.01)

(52) U.S. Cl.
CPC ..... *G03G 15/6529* (2013.01); *G03G 15/6573* (2013.01)

(58) Field of Classification Search
CPC ..... B65H 2403/45; B65H 2403/511; B65H 2403/51; B65H 2404/15; B65H 2404/152; B65H 2404/1521; B65H 2404/1526; B65H 2404/161; B65H 2404/183; B65H 2404/144; B65H 2404/1442; B65H 2301/3612; B65H 2301/162;B65H 2301/4219; B65H 2301/42194; B65H 2404/1421; B65H 2404/1422; B65H 2404/1423; G03G 15/6552; G03G 15/6573; G03G 15/6529
See application file for complete search history.

(56) References Cited

U.S. PATENT DOCUMENTS

2002/0084572 A1* 7/2002 Kim ..... 271/81
2011/0187048 A1* 8/2011 Massoud ..... 271/225

FOREIGN PATENT DOCUMENTS

EP 0524535 A1 * 1/1993 ..... B65H 9/04
JP A-3-42460 2/1991

* cited by examiner

*Primary Examiner* — Matthew G Marini
(74) *Attorney, Agent, or Firm* — Oliff PLC

(57) ABSTRACT

Provided is a recording material transporting apparatus including a transport member that transports a recording material in a transport direction, a linkage portion that moves in an intersection direction in connection with movement of the transport member in the direction intersecting the transport direction, and a rotating member that rotates about a rotating shaft disposed along the intersection direction, that includes a helical cam on a circumference of the rotating shaft, and that presses the linkage portion via the cam to move the linkage portion and the transport member in the intersection direction, wherein a common driving source supplies a driving force that the transport member uses to transport the recording material, and a driving force for rotating the rotating member.

20 Claims, 9 Drawing Sheets

RECORDING MATERIAL TRANSPORTING APPARATUS, AND IMAGE FORMING APPARATUS

CROSS-REFERENCE TO RELATED APPLICATIONS

This application is based on and claims priority under 35 USC 119 from Japanese Patent Application No. 2014-064741 filed Mar. 26, 2014.

BACKGROUND

Technical Field

The present invention relates to a recording material transporting apparatus, and an Image forming apparatus.

SUMMARY

According to an aspect of the invention, there is provided a recording material transporting apparatus including:

a transport member that transports a recording material in a transport direction;

a linkage portion that moves in an intersection direction in connection with movement of the transport member in the direction intersecting the transport direction; and a rotating member that rotates about a rotating shaft disposed along the intersection direction, that includes a helical cam on a circumference of the rotating shaft, and that presses the linkage portion via the cam to move the linkage portion and the transport member in the intersection direction, wherein a common driving source supplies a driving force that the transport member uses to transport the recording material, and a driving force for rotating the rotating member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the accompanying drawings.

Figure 1:
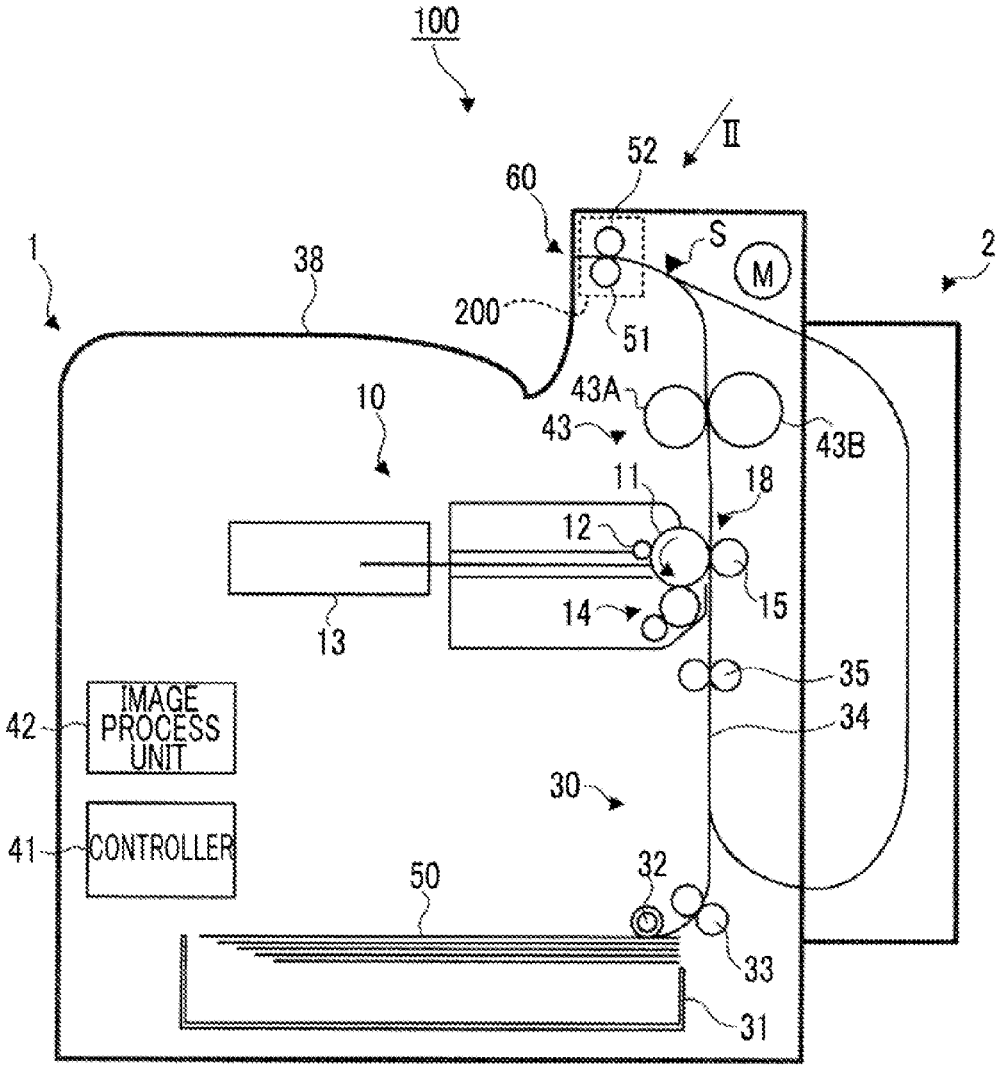
FIG. 1 is a view illustrating the entire configuration of an image forming apparatus according to the exemplary embodiment.

FIG. 1 is a view illustrating the entire configuration of an image forming apparatus 100 according to the exemplary embodiment.

The image forming apparatus 100 of the exemplary embodiment is provided with an image forming unit 10 that forms a toner image on a sheet 50 which is an example of a recording material, and a sheet transporting system 30 that transports the sheet 50.

The image forming apparatus 100 is provided with a fixing device 43 that heats and applies pressure to the sheet 50 having the toner image formed by the image forming unit 10, thereby fixing the toner image on the sheet 50. The image forming apparatus is provided with a controller 41 that includes a CPU which is program controlled, and that controls each unit of the image forming apparatus 100. The image forming apparatus is provided with an image process unit 42 that processes image data output from a PC or a scanner.

The image forming unit 10, an example of image forming unit, is provided with a photosensitive drum 11; a charging unit 12; an exposure unit 13; a developing device 14; a transfer unit 15; and a cleaning unit (not illustrated).

The photosensitive drum 11 includes a photosensitive layer on an outer circumferential surface thereof, and rotates in the arrow direction in FIG. 1. The charging unit 12 charges the rotating photosensitive drum 11 to a predetermined potential. The exposure unit 13 selectively exposes the photosensitive drum 11 to light with the photosensitive drum 11 charged by the charging unit 12, thereby forming an electrostatic latent image on the photosensitive drum 11.

The developing device 14 develops the electrostatic latent image formed on the photosensitive drum 11 with a toner, thereby forming a toner image on the photosensitive drum 11. The transfer unit 15 is disposed to face the photosensitive drum 11, and a transfer portion 18 is formed between the transfer unit 15 and the photosensitive drum 11. In the transfer portion 18, the toner image formed on the photosensitive drum 11 is electrostatically transferred onto the sheet 50 that is transported by the sheet transporting system 30. The cleaning unit (not illustrated) removes the remaining toner and the like from the photosensitive drum 11 after the transfer process is completed.

The fixing device 43 is disposed downstream of the image forming unit 10 in a transport direction of the sheet 50. The fixing device 43 is provided with a pair of roll-like members 43A and 43B which are in press contact with each other. The fixing device 43 is provided with a heating source (not illustrated) such as a halogen heater. The fixing device 43 heats and applies pressure to the sheet 50 that holds the toner image, and thus fixes the toner image on the sheet 50.

The sheet transporting system 30 is provided with an accommodating unit 31 that accommodates the sheet 50 therein; a feed roller 32 that feeds the sheet 50 out of the accommodating unit 31; and a feed roller 33 that separates and transports the sheets 50 fed by the feed roller 32 one by one.

The sheet transporting system 30 is provided with a sheet transport path 34 via which the feed roller 33 separates and transports the sheets 50 one by one. The sheet transport path 34 is formed so as to reach a sheet discharge port 60 provided in an upper portion of the image forming apparatus 100, via the imaging forming unit 10. The sheet transporting system. 30 is provided with a registration roll 35 that transports the sheet 50 to the transfer portion 18.

A discharge roll 52, an example of a transport member, is provided downstream of the fixing device 43 in the transport direction of the sheet 50. The discharge roll 52 transports the sheet 50 transported from an upstream side thereof to the sheet discharge port 60, and discharges the sheet 50 out of the image forming apparatus 100. Accordingly, in the exemplary embodiment, the sheets 50 stack on a sheet stacking surface 38 that is provided in the upper portion of the image forming apparatus 100.

In the exemplary embodiment, a follower roll 51 is provided in such a manner that the follower roll 51 is pushed against the discharge roll 52, and is driven to rotate by the discharge roll 52. The image forming apparatus 100 is provided with a motor M as a driving source that rotates the discharge roll 52.

In the exemplary embodiment, the image forming apparatus 100 is provided with a roll moving mechanism 200 that moves the discharge roll 52 and the follower roll 51 in a direction (a direction orthogonal to (intersecting) the sheet surface of FIG. 1) orthogonal to (intersecting) the transport direction of the sheet 50. A trailing edge detecting sensor S is provided upstream of the discharge roll 52, and downstream of the fixing device 43 in the transport direction of the sheet. The trailing edge detecting sensor S detects a trailing edge portion of the transported sheet 50.

In the exemplary embodiment, a re-transport unit 2 is provided, and enables an image to be formed on both surfaces of the sheet 50. When an image is formed on both surfaces of the sheet 50, the sheet 50 passing through the fixing device 43 is again fed upstream of the transfer portion 18 via the re-transport unit 2. Thereafter, the sheet 50 passes through the transfer portion 18.

At this time, the front and back surfaces of the sheet 50 are inverted, and in the transfer portion 18, a toner image is transferred onto an opposite surface of a surface on which the image is already formed. Thereafter, the sheet 50 is discharged out of the image forming apparatus 100 via the fixing device 43.

A basic operation of the image forming apparatus 100 will be described.

First, image data formed in a personal computer (not illustrated) or the like is input to the image process unit 42 in order for an image to be formed in the image forming apparatus 100. The image process unit 42 processes the input image data in a predetermined manner. The processed image data is output to the exposure unit 13.

The exposure unit 13 receiving the image data selectively exposes the photosensitive drum 11 to light, the photosensitive drum 11 being charged to a predetermined potential by the charging unit 12, thereby forming an electrostatic latent image on the outer circumferential surface of the photosensitive drum 11. For example, the developing device 14 develops the formed electrostatic latent image into a black (K) toner image.

In contrast, coincident with the formation of the image, the feed roller 32 in the sheet transporting system 30 rotates, and the sheet 50 is supplied from the accommodating unit 31 to the sheet transport path 34. The sheet 50, which the feed roller 33 separates one by one, is transported to the registration roll 35, and is stopped for the moment.

Thereafter, coincident with the rotation of the photosensitive drum 11 having the toner image formed thereon, the registration roll 35 rotates, and the sheet 50 is transported to the transfer portion 18. In the transfer portion 18, the toner image formed on the photosensitive drum 11 is transferred onto the sheet 50. Thereafter, the fixing device 43 fixes the transferred toner image on the sheet 50, and then the discharge roll 52 discharges the sheet 50 onto the sheet stacking surface 38.

Figure 2:
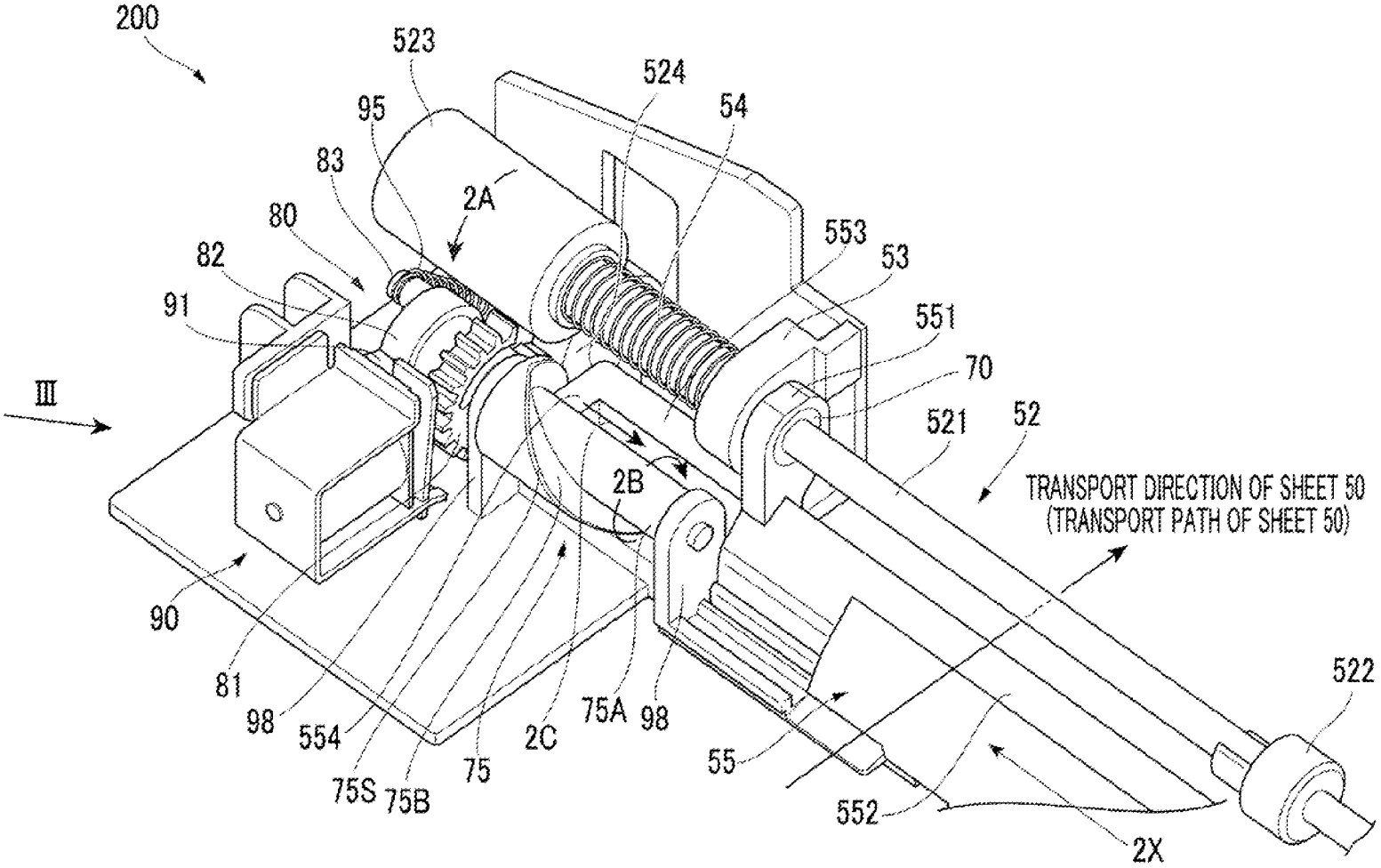
FIG. 2 is a view illustrating a discharge roll, a roll moving mechanism, and the like when seen from arrow II in FIG. 1.
Figure 3:
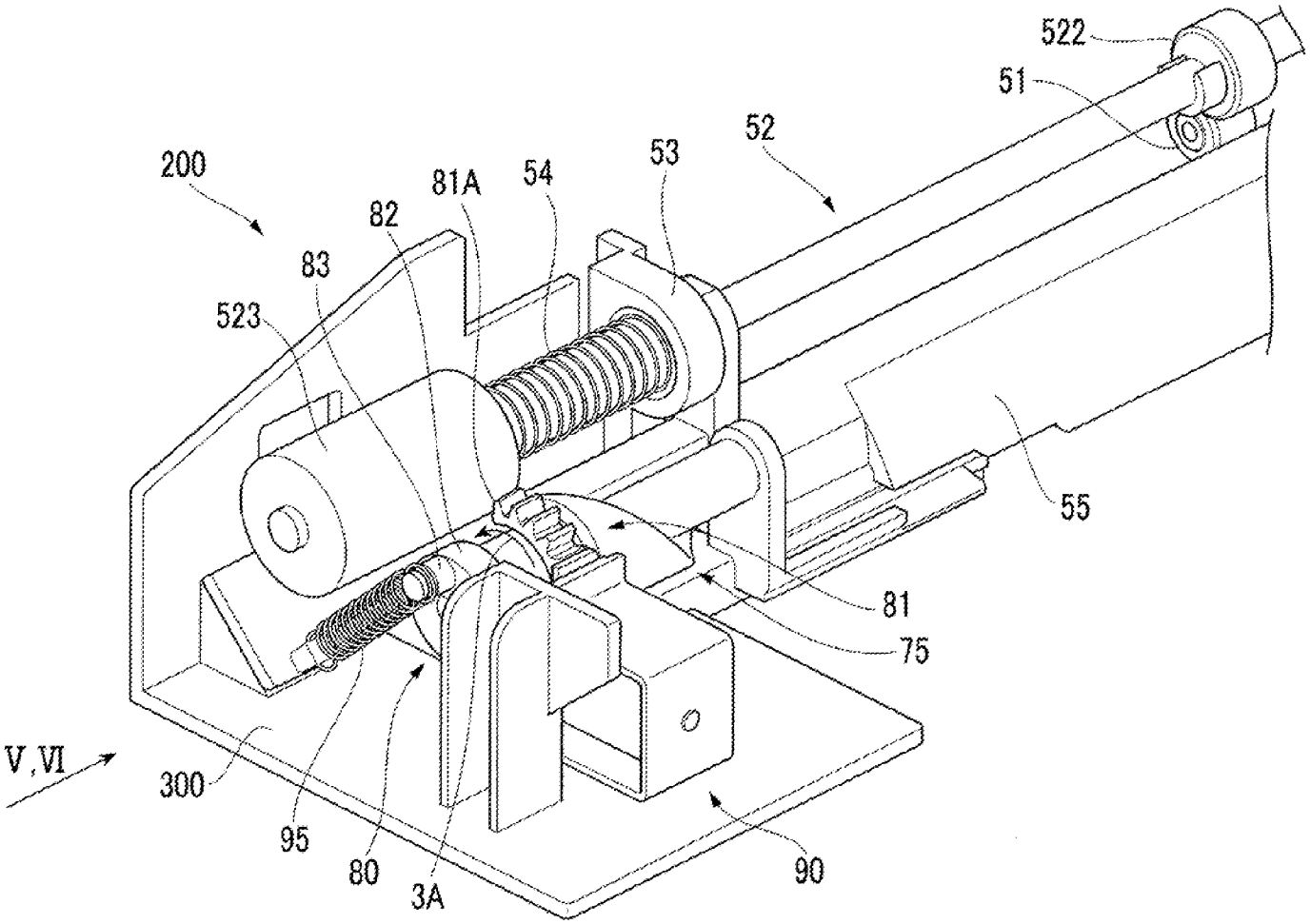
FIG. 3 is a view illustrating the discharge roll, the roll moving mechanism, and the like when seen from arrow III in FIG. 2.

FIG. 2 is a view illustrating the discharge roll 52, the roll moving mechanism 200, and the like when seen from arrow II in FIG. 1. FIG. 3 is a view illustrating the discharge roll 52, the roll moving mechanism 200, and the like when seen from arrow III in FIG. 2.

As illustrated in FIG. 2, the discharge roll 52 of the exemplary embodiment includes a rotating shaft 521 that extends along a direction orthogonal to (intersecting) the transport direction of the sheet 50, and an elastic member 522 that has a disc shape and is attached to the rotating shaft 521.

In the exemplary embodiment, while the sheet 50 is nipped between the elastic member 522 and the follower roll 51 (refer to FIG. 3) that is pushed against the elastic member 522, the discharge roll 52 rotates. Accordingly, the sheet 50 is discharged out of the image forming apparatus 100 via the sheet discharge port 60 (refer to FIG. 1).

In the exemplary embodiment, as illustrated in FIG. 2, a receiving gear 523 is attached to an end portion of the rotating shaft 521, and receives a rotating driving force. Teeth are formed on an outer circumferential surface of the receiving gear 523, but are not illustrated in FIG. 2. In the exemplary embodiment, a supply gear 524 is disposed in a state of meshing with the receiving gear 523, and supplies a rotating driving force from the motor M (refer to FIG. 1) to the receiving gear 523.

A supporting member 53 is provided to support the rotating shaft 521. A coil spring 54 for a roll, an example of biasing unit, is provided between the supporting member 53 and the receiving gear 523, and biases the discharge roll 52 in an upper left direction in FIG. 2. In other words, the coil spring 54 for a roll is provided in such a manner that the discharge roll 52 is biased to separate from the transport path of the sheet 50 by the coil spring 54 for a roll.

In the exemplary embodiment, the receiving gear 523 receives a rotating driving force from the supply gear 524, thereby rotating the discharge roll 52 in a direction as illustrated by arrow 2A in FIG. 2. In the exemplary embodiment, the sheet 50 transported from an upstream side of the discharge roll 52 is fed toward the sheet discharge port 60 (refer to FIG. 1) due to the rotation of the discharge roll 52.

A sheet guide member 55 is not described above, but as illustrated in FIGS. 2 and 3, the sheet guide member 55 is provided upstream of the discharge roll 52 and the follower roll 51 in the transport direction of the sheet 50. In the exemplary embodiment, due to the sheet guide member 55, the sheet 50 transported from the upstream side of the discharge roll 52 is guided toward a nipping portion formed by the discharge roll 52 and the follower roll 51.

The following is omitted in the description above, the follower roll 51 (refer to FIG. 3) is attached to the sheet guide member 55 via a bearing (not illustrated), and is supported by the sheet guide member 55 via the bearing. For this reason, when the sheet guide member 55 moves in the direction orthogonal to the transport direction of the sheet 50 (the detailed description will foe given later), the follower roll 51 also moves along with the sheet guide member 55 in the orthogonal direction.

In the exemplary embodiment, as illustrated in FIG. 2, the sheet guide member 55 is provided with a fixed portion 551 fixed to the rotating shaft 521 of the discharge roll 52. Accordingly, when the sheet guide member 55 moves in the direction orthogonal to the transport direction of the sheet 50 (the detailed description will be given later), the discharge roll 52 also moves along with the sheet guide member 55 in the orthogonal direction.

A bearing 70 is provided between the fixed portion 551 and the rotating shaft 521 of the discharge roll 52, and thus the sheet guide member 55 does not rotate when the discharge roll 52 rotates. In the exemplary embodiment, since the bearing 70 is fixed to the rotating shaft 521, when the sheet guide member 55 moves in the orthogonal direction as described above, the discharge roll 52 also moves in the orthogonal direction along with the sheet guide member 55.

Here, as illustrated in FIG. 2, the sheet guide member 55 is provided with a guide member body 552 that is provided across the transport path of the sheet 50 and guides the sheet 50 transported from an upstream side of the sheet guide member 55.

The sheet guide member 55 is provided with a first protruding piece 553 that protrudes from one end of the guide member body 552 in a longitudinal direction of the guide member body 552. The first protruding piece 553 is disposed along the direction orthogonal to the transport direction of the sheet 50, and is disposed along the extended line of the guide member body 552.

The sheet guide member 55 is provided with a second protruding piece 554 that protrudes from the first protruding piece 553. The second protruding piece 554 protrudes in a direction orthogonal to an extension direction of the first protruding piece 553.

Subsequently, the configuration of the roll moving mechanism 200 will be described.

As illustrated in FIG. 2, the roll moving mechanism 200 is provided with a push-out member 75 that pushes out the second protruding piece 554 provided in the sheet guide member 55. The roll moving mechanism 200 is provided with a coaxial member 80 that is disposed coaxially with the push-out member 75 and rotates the push-out member 75. The roll moving mechanism 200 is provided with a solenoid 90 that includes a flapper 91 and regulates the rotation of the coaxial member 80. An imparting spring 95 (also refer to FIG. 3) is provided to impart a rotating force to the coaxial member 80.

Here, as illustrated in FIG. 2, the push-out member 75, an example of a rotating member, rotates about a rotating shaft 75A that is disposed along a direction orthogonal to the transport direction of the sheet 50. In other words, the rotating shaft 75A is disposed along an extension direction of the discharge roll 52 (the rotating shaft 521 of the discharge roll 52). The push-out member 75 rotates about the rotating shaft 75A (the rotating shaft 75A is disposed in parallel with the extension direction of the discharge roll 52) that is disposed along the extension direction of the discharge roll 52.

The push-out member 75 includes a cam surface (a cam) 75B that pushes out the second protruding piece 554 provided in the sheet guide member 55. The cam surface 75B is provided on the circumference of the rotating shaft 75A. In addition, the cam surface 75B is helically disposed on the circumference of the rotating shaft 75A.

The following is omitted in the description above, but in the exemplary embodiment, opposite ends of the push-out member 75 in its axial direction are supported by a supporting member 98.

Figure 4:
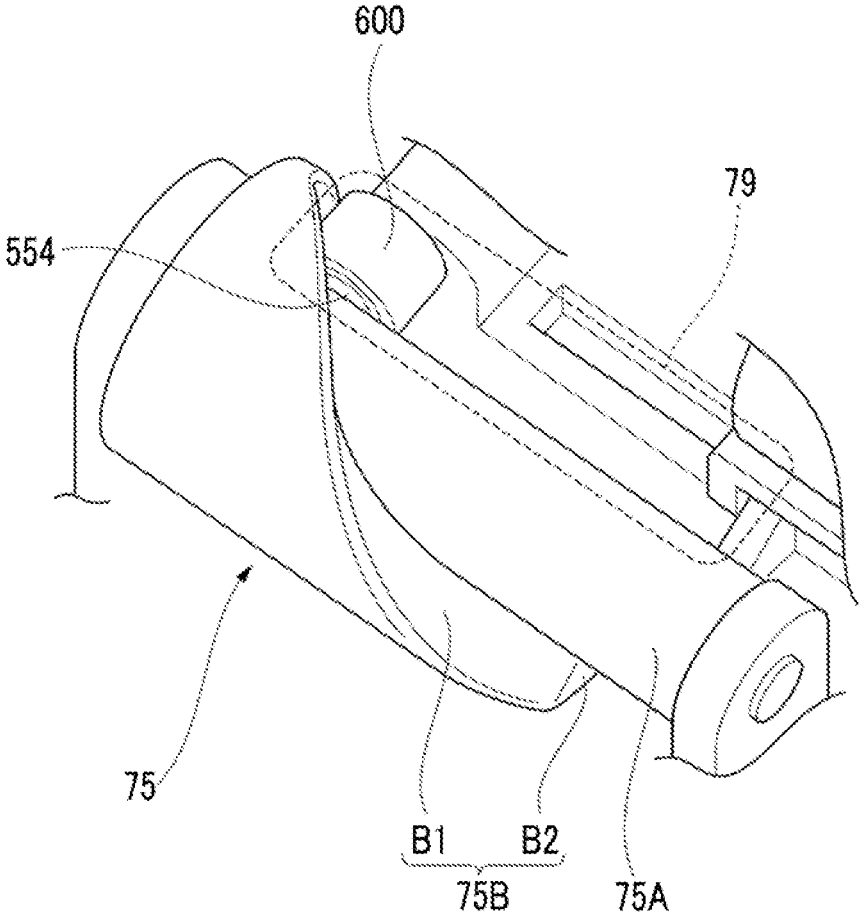
FIG. 4 is a view illustrating a push-out member when seen from an angle different from that in FIG. 2.

FIG. 4 is a view illustrating the push-out member 75 when seen from an angle different from, that in FIG. 2. In FIG. 4, the push-out member 75 is rotated further than when seen in FIG. 2.

As illustrated in FIG. 4, the cam surface 75B is provided with a first cam surface B1 having a helical shape. In addition, the cam surface 75B is provided with a second cam surface B2 that is not helical-shaped and is formed along a circumferential direction of the rotating shaft 75A (is formed along a plane orthogonal to the rotating shaft 75A).

In the exemplary embodiment, as illustrated in FIG. 4, the push-out member 75 has a non-cam region 79 which is disposed along the axial direction (longitudinal direction) of the push-out member 75, and in which the cam surface 75B is not formed. In other words, in the push-out member 75 of the exemplary embodiment, the cam surface 75B is not formed on the entire circumference of the push-out member 75 in a circumferential direction of the push-out member 75, and the non-cam region 79 extending along the axial direction of the push-out member 75 exists in a part of a circumferential region in the circumferential direction of the push-cut member 75.

FIG. 4 illustrates a portion of the configuration of the push-out member 75, the portion is not illustrated in FIGS. 2 and 3. A rotating member (a roll member) 600 is attached to the second protruding piece 554, thereby reducing sliding resistance occurring between the push-out member 75 and the second protruding piece 554.

Hereinafter, detailed description will be given with reference to FIG. 2. In the exemplary embodiment, when an end portion 75S (an end portion in a radial direction of the push-out member 75, and a portion in which an outer circumferential surface of the push-out member 75 intersects the cam surface 75B) of the cam surface 75B is seen from the axial direction of the push-out member 75 (seen from arrow 2X in FIG. 2), the end portion 75S is not formed on the entire circumference of the push-out member 75, and the push-out member 75 has a non-formation region in which the end portion 75S is not formed in the circumferential direction of the push-out member 75. More specifically, in the exemplary embodiment, when the curved line of the helically formed end portion 75S is seen in the axial direction of the push-out member 75, the non-formation region exists in which the end portion 75S is not formed.

More specifically, in the exemplary embodiment, the cam surface 75B is formed only on an upstream side of the push-out member 75 in a movement direction of the discharge roll 52, and when the second protruding piece 554 functioning as a linkage portion reaches a downstream side of the cam surface 75B, the second protruding piece 554 reaches the non-formation region. Accordingly, the second protruding piece 554 moves in an opposite direction of the movement direction of the discharge roll 52 (a detailed description will be given later).

Subsequently, the coaxial member 80 will be described.

As illustrated in FIG. 2, the coaxial member 80 is provided with a missing tooth gear portion 81, and a flapper contact portion 82 that is in contact with the flapper 91 of the solenoid 90. An end surface of the coaxial member 80 on a deeper side in FIG. 2 is provided with an attached portion 83 that protrudes from the end surface and is attached to an end of the imparting spring 95.

Referring to FIG. 3, as described above, the end of the imparting spring 95 is attached to the attached portion 83 provided in the coaxial member 80. In contrast, the other end of the imparting spring 95 is fixed to a frame 300 provided in the roll moving mechanism 200.

In the exemplary embodiment, when the imparting spring 95 imparts a rotating force to the coaxial member 80, the solenoid 90 is turned on, and the flapper 91 (refer to FIG. 2) separates from the flapper contact portion 82, the coaxial member 80 rotates in a direction as illustrated by arrow 3A in FIG. 3. The rotation of the coaxial member 80 causes a gear portion 81A of the missing tooth gear portion 81 to be brought into contact with the receiving gear 523.

Figure 5A:
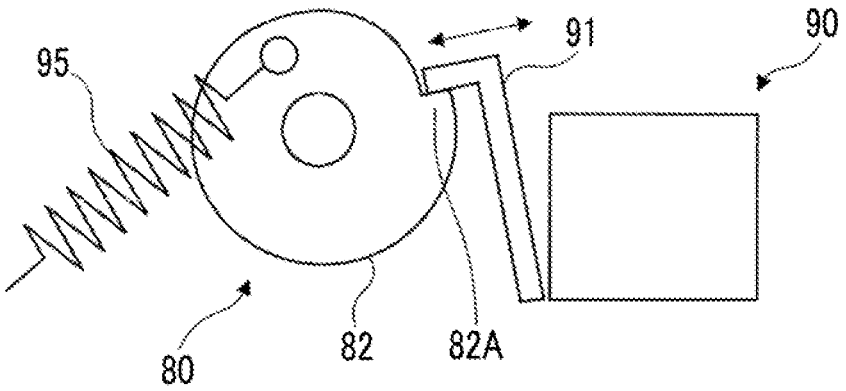
FIGS. 5A and 5B are views illustrating a solenoid, a flapper contact portion of a coaxial member, and an imparting spring when seen from arrow V in FIG. 3.
Figure 5B:
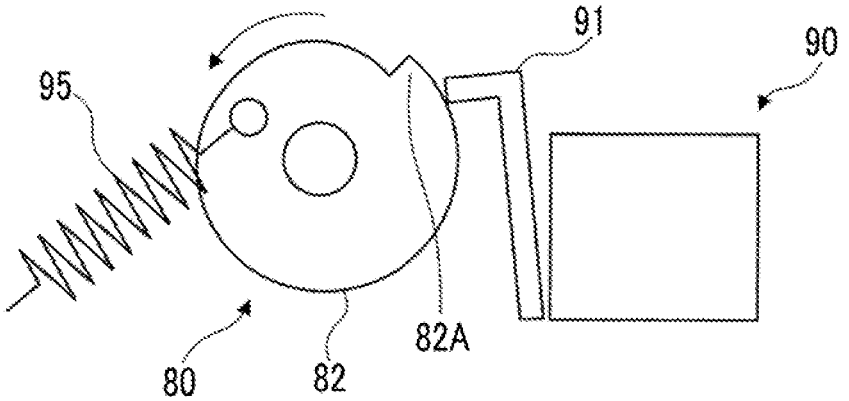

FIGS. 5A and 5B are views illustrating the solenoid 90, the flapper contact portion 82 of the coaxial member 80, and the imparting spring 95 when seen from arrow V in FIG. 3.

The following is omitted in the description above, but in the exemplary embodiment, as illustrated in FIG. 5A, a protruding portion 82A is provided on an outer circumferential surface of the flapper contact portion 82, and the flapper 91 of the solenoid 90 is hooked onto the protruding portion 82A. Accordingly, the imparting spring 95 imparts a rotating force to the coaxial member 80, nevertheless, the coaxial member 80 does not rotate.

In contrast, when the solenoid 90 is turned on, and the flapper 91 moves toward the body of the solenoid 90, as illustrated in FIG. 5B, the hooking of the flapper 91 and the protruding portion 82A is released, and the coaxial member 80 starts rotating. In the exemplary embodiment, the solenoid 90 is turned off, and the flapper 91 is pressed against the flapper contact portion 82 immediately after the hooking is released (in a period of time from the release of the hooking to one rotation of the coaxial member 80). For this reason, when the coaxial member 80 makes one rotation, the flapper 91 is hooked onto the protruding portion 82A again, and the coaxial member 80 is stopped.

Figure 6:
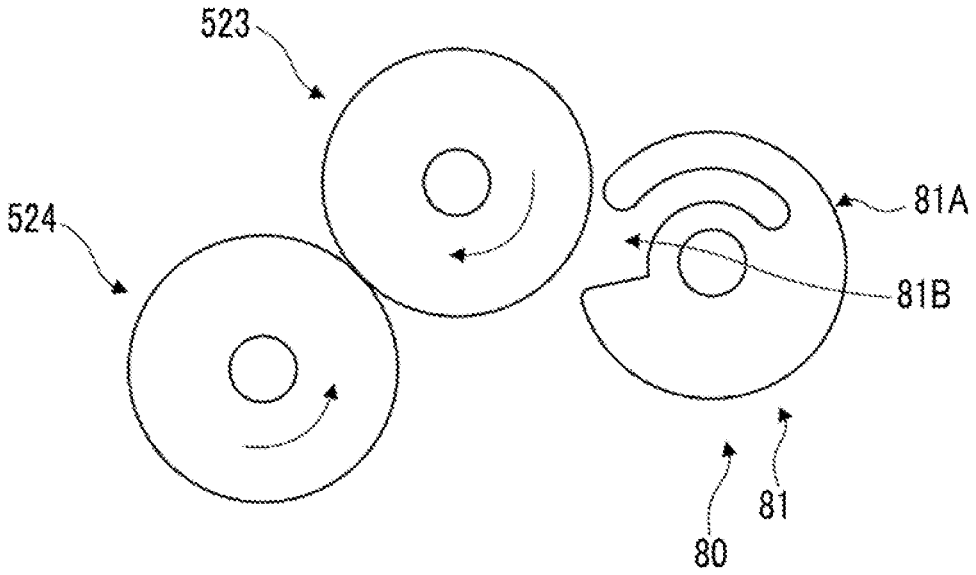
FIG. 6 is a view illustrating a missing tooth gear portion of the coaxial member, a receiving gear, and a supply gear when seen from arrow VI in FIG. 3.

FIG. 6 is a view illustrating the missing tooth gear portion 81 of the coaxial member 80, the receiving gear 523, and the supply gear 524 when seen from arrow VI in FIG. 3.

A missing tooth portion 81B is provided on an outer circumferential surface of the missing tooth gear portion 81, and teeth are not formed in the missing tooth portion 81B. The gear portion 81A is provided in locations other than the missing tooth portion 81B of the missing tooth gear portion 81, and is provided with a gear (teeth).

When the solenoid 90 is not turned on, and the flapper 91 is hooked onto the protruding portion 82A, as illustrated in FIG. 6, the missing tooth portion 81B confronts (is disposed at a facing position) the receiving gear 523 which is an example of a transmission gear, and the receiving gear 523 and the coaxial member 80 are not in contact with each other.

Here, the missing tooth gear portion 81 functions as shut off unit. When the discharge roll 52 does not move in the axial direction (a detailed description will be given later), the missing tooth gear portion 81 shuts off a rotating driving force transmitted from the receiving gear 523 to the push-out member 75. Accordingly, the push-out member 75 does not rotate, and the discharge roll 52 does not move.

In contrast, as illustrated in FIG. 5B, when the solenoid 90 is turned on, and the coaxial member 80 starts rotating, the receiving gear 523 starts meshing with the gear portion 81A. Accordingly, the coaxial member 80 rotates by receiving a rotating driving force from the receiving gear 523. When the missing tooth portion 81B of the coaxial member 80 confronts the receiving gear 523 again, the coaxial member 80 stops rotating.

Here, the motion of the discharge roll 52 and the like when the solenoid 80 is turned on and the coaxial member 80 makes one rotation will be described with reference to FIG. 2.

As described above, when the solenoid 90 is turned on, the coaxial member 80 starts rotating. In connection with the rotation of the coaxial member 80, the push-out member 75 rotates in a direction illustrated by arrow 2B in FIG. 2.

Accordingly, as illustrated by arrow 2C in FIG. 2, the cam surface 75B moves the second protruding piece 554 of the sheet guide member 55 in the orthogonal direction of the transport direction of the sheet 50. Here, since the second protruding piece 554 functioning as a linkage portion moves in connection with the follower roll 51 (not illustrated in FIG. 2) and the discharge roll 52, when the second protruding piece 554 moves in the orthogonal direction of the transport direction of the sheet 50, the follower roll 51 and the discharge roll 52 also move in the orthogonal direction.

When the rotation angle of the push-out member 75 reaches a predetermined angle, contact between the cam surface 75B and the sheet guide member 55 (the second protruding piece 554 of the sheet guide member 55) is released. In other words, in the exemplary embodiment, when the discharge roll 52 pressed by the cam surface 75B reaches a predetermined location, the second protruding piece 554 reaches the non-cam region 79 (refer to FIG. 4) (the second protruding piece 554 enters the non-cam region 79), and the pressing of the second protruding piece 554 by the cam surface 75B is released. In the exemplary embodiment, when the second protruding piece 554 reaches the non-cam region 79, the missing tooth portion 81B of the missing tooth gear portion 81 confronts the receiving gear 523, and the transmission of a driving force to the push-out member 75 is shut off.

Thereafter, since the discharge roll 52 is pressed by the coil spring 54 for a roll which functions as the biasing unit, the discharge roll 52 moves in an opposite direction of the direction in which the discharge roll 52 is pressed to move by the cam surface 75B. Accordingly, the discharge roll 52 returns to its original position at which the push-out member 75 is located before being pushed out. In the exemplary embodiment, when the discharge roll 52 moves in the opposite direction, the second protruding piece 554 passes through the non-cam region 79.

Here, in the exemplary embodiment, the discharge roll 52 moves in the orthogonal direction of the transport direction of the sheet 50 in this manner. Accordingly, when the discharge roll 52 moves with the sheet 50 nipped between the discharge roll 52 and the follower roll 51, the stacking position of the sheet 50 becomes offset. In other words, in the exemplary embodiment, it is possible to perform a so-called offset operation in which the sheets 50 are split in the direction intersecting the transport direction of the sheet, and then are discharged. When the stacking position of the sheet 50 becomes offset as in the exemplary embodiment (when it is possible to perform an offset operation), it is possible to simply sort the sheets 50 (the sheets 50 that stack on the sheet stacking surface 38) having an image formed thereon.

In the exemplary embodiment, the length of the receiving gear 523 in the axial direction of the discharge roll 52 (in the moving direction of the discharge roll 52) is set to be greater than the amount of offset of the discharge roll 52. Accordingly, even when the discharge roll 52 moves in the axial direction, contact between the supply gear 524 and the receiving gear 523 is maintained.

Here, the motion of the sheet 50 when the discharge roll 52 moves (when an offset operation is performed) will be described with reference to FIGS. 7A to 7D (views that illustrate the motion of the sheet 50 when the discharge roll 52 moves). FIGS. 7A to 7D illustrate a state when the image forming apparatus 100 is seen from above.

As described above and illustrated in FIG. 7A, in the exemplary embodiment, the trailing edge detecting sensor S is provided upstream of the discharge roll 52, and detects the trailing edge portion of the transported sheet 50. In the exemplary embodiment, when the sheet 50 is transported to the trailing edge detecting sensor S, the trailing edge detecting sensor S detects the trailing edge portion of the sheet 50.

Figure 7A:
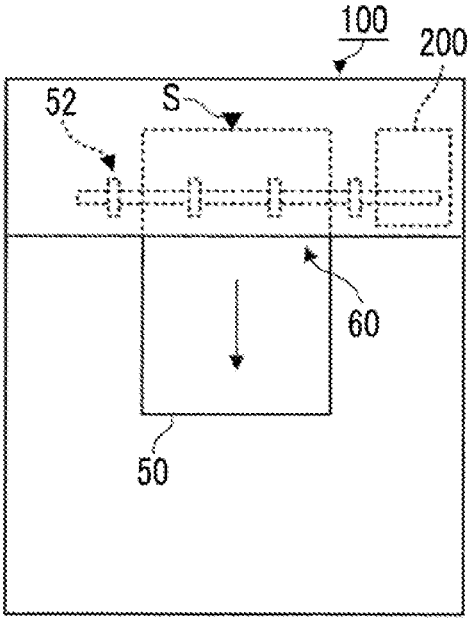
FIGS. 7A to 7D are views illustrating a motion of a sheet when the discharge roll moves.
Figure 7C:
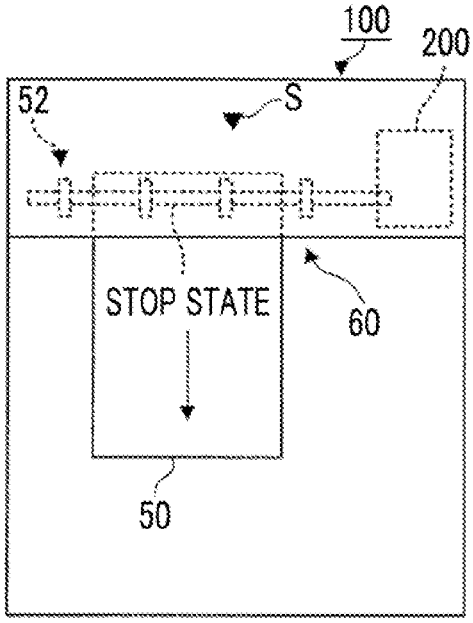
Figure 7B:
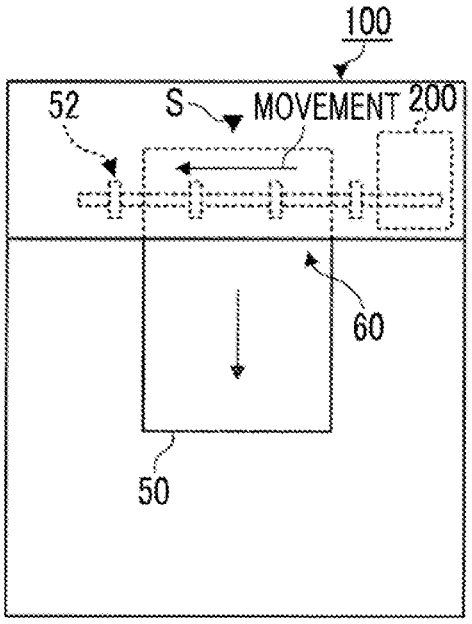

In the exemplary embodiment, when the trailing edge detecting sensor 5 detects the trailing edge portion of the sheet 50, and then a predetermined period of time elapses, as illustrated in FIG. 7B, the roll moving mechanism 200 moves the discharge roll 52 in the orthogonal direction of the transport direction of the sheet 50 (also moves the follower roll 51 and the sheet guide member 55). Specifically, as described above, the solenoid 90 is set to be turned on temporarily, thereby moving the discharge roll 52.

In the exemplary embodiment, as described above, since the second cam surface B2 (refer to FIG. 4) is formed on the cam surface 75B along the circumferential direction of the push-out member 75, when the discharge roll 52 reaches a predetermined location, as illustrated in FIG. 7C, the discharge roll 52 stops moving, and temporarily stays at the predetermined location.

Figure 7D:
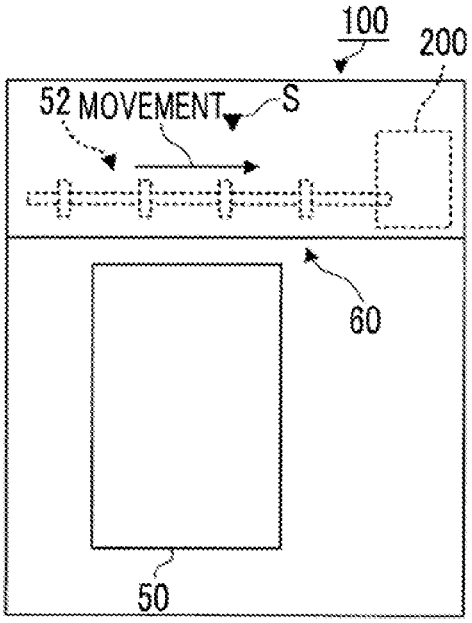

Subsequently, in the exemplary embodiment, the trailing edge portion of the sheet 50 comes out of the discharge roll 52, contact between the second cam surface B2 and the sheet guide member 55 (the second protruding piece 554 of the sheet guide member 55) is released, and as illustrated in FIG. 7D, the discharge roll 52 moves again, and returns to its original, position.

Here, in the exemplary embodiment, as described above, before the trailing edge portion of the sheet 50 comes out of the discharge roll 52, the discharge roll 52 is set to stop. Accordingly, the stacking position of the sheet 50 becomes stable.

When the sheet 50 comes out of the discharge roll 52 in the middle of the movement of the discharge roll 52, the sheet 50 moves in the orthogonal direction due to an inertia force being imparted in the orthogonal direction of the transport direction of the sheet 50. At this time, the stacking position of the sheet 50 is likely to be unstable. In contrast, in the exemplary embodiment, an inertia force being imparted in the orthogonal direction of the transport direction of the sheet 50 is unlikely to be imparted to the sheet 50, and the stacking position of the sheet 50 becomes stable.

In the exemplary embodiment, electrical power required to move the discharge roll 52 decreases. In other words, power consumption required for an offset process of the sheet 50 decreases.

In the related art, a dedicated moving motor is prepared to move the discharge roll 52, and moves the discharge roll 52. At this time, power consumption increases by the amount of electric power required to drive the moving motor. In contrast, in the exemplary embodiment, the dedicated motor is not used to move the discharge roll 52, but the motor M (refer to FIG. 1) prepared for rotating the discharge roll 52 is used to move the discharge roll 52. For this reason, power consumption decreases compared to when the dedicated motor is prepared to move the discharge roll 52.

In the exemplary embodiment, since the dedicated motor is not prepared, the number of motors decreases, and thus costs are reduced.

When the dedicated motor is used, a sensor (a sensor for detecting a home position) for detecting the position of the discharge roll 52 is also required to be prepared. However, in the configuration of the exemplary embodiment, the sensor is not provided, and for this reason, costs are reduced.

In the exemplary embodiment, a driving force is transmitted, from the common motor M to each of the discharge roll 52 and the push-out member 75, thereby rotating the discharge roll 52 and the push-out member 75. However, when a rotating driving force is transmitted to each of the discharge roll 52 and the push-out member 75, first, the rotating driving force is transmitted from, the motor M to the discharge roll 52. More specifically, a rotating driving force is transmitted to the receiving gear 523 (an example of a driving force reception portion) that is attached to the discharge roll 52.

Subsequently, in the exemplary embodiment, a rotating driving force is transmitted from the receiving gear 523 to the push-out member 75. Accordingly, the driving force transmission mechanism becomes simplified.

Here, For example, a configuration may be also considered in which a driving force transmission path branches upstream of the receiving gear 523, and a driving force is supplied via a branching portion to each, of the receiving gear 523 and the push-out member 75. However, when the branches of the driving force transmission path are made, the driving force transmission mechanism is likely to become complicated. In contrast, since the exemplary embodiment has the configuration in which the branches of the driving force transmission path are not made, the driving force transmission mechanism becomes simplified.

Figure 8A:
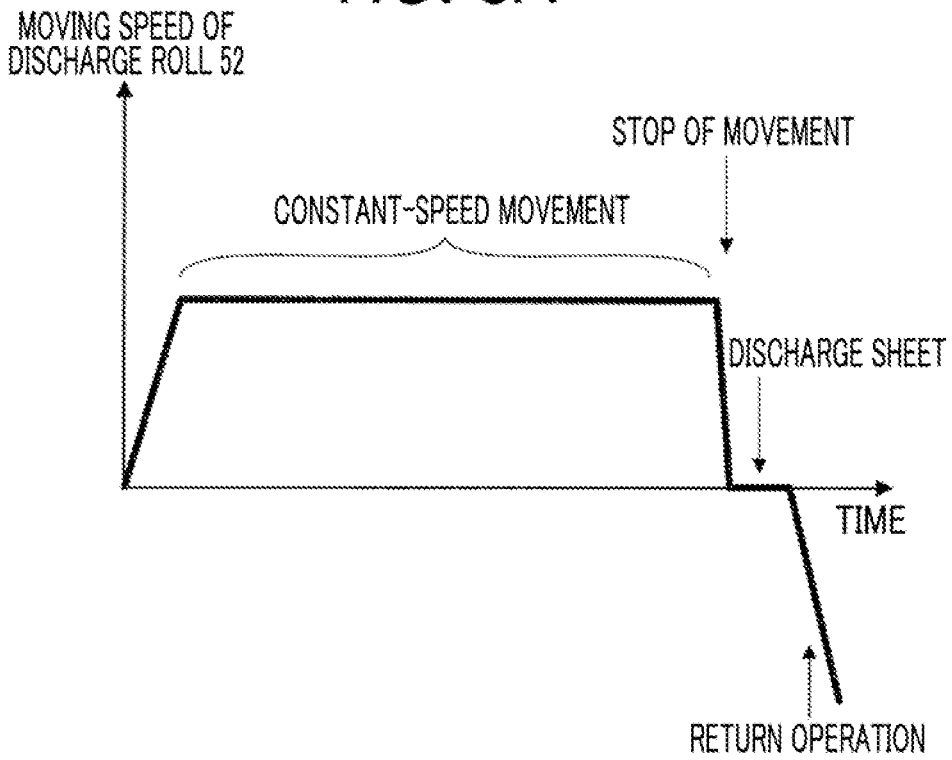
FIGS. 8A and 8B are graphs describing the moving speed of the discharge roll.
Figure 8B:
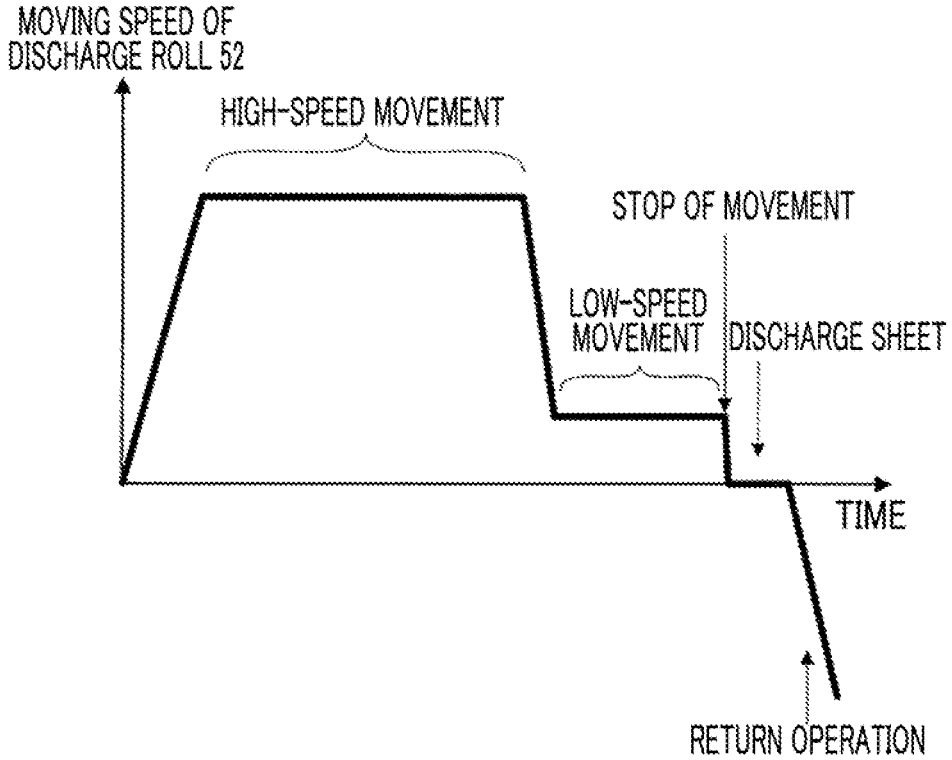

FIGS. 8A and 8B are graphs describing the moving speed of the discharge roll 52.

In the exemplary embodiment, the moving speed of the discharge roll 52 is determined by the cam surface 75B. When the shape of the cam surface 75B is changed, the moving speed of the discharge roll 52 is changed.

FIG. 8A is a graph illustrating the moving speed of the discharge roll 52 when the inclined angle of the first cam surface B1 (refer to FIG. 4) is set to be constant.

When the inclined angle of the first cam surface B1 is set to be constant, the discharge roll 52 moves at a constant speed. Here, when the discharge roll 52 moves at a constant speed, a stacking disturbance of the sheets 50 already stacked on the sheet stacking surface 38 is unlikely to occur.

When the sheets 50 are discharged on the sheet stacking surface 38, a lot of the sheets 50 (hereinafter, referred to as "stacked sheets 50") are already stacked on the sheet stacking surface 38. At this time, the sheets 50 to be discharged (hereinafter, referred to as "discharged sheets 50") slide along over the stacked sheets 50.

When the discharge roll 52 moves at a constant speed in these conditions, the discharged sheet 50 moves over the stacked sheets 50 at a constant speed. At this time, the discharged sheet 50 is prevented from imparting a changing load (a frictional force) to the stacked sheets 50, and a stacking disturbance of the stacked sheets 50 is unlikely to occur, compared to when the load changes.

In the example illustrated in FIG. 8B, the moving speed of the discharge roll 52 decreases immediately before the sheet 50 is discharged (immediately before the sheet 50 comes out of the discharge roll 52). In other words, a rear half portion of the first cam surface B1 is set to have a small inclined angle (an inclined angle, with respect to an orthogonal plane orthogonal to the axial direction of the push-out member 75), and thus the moving speed of the discharge roll 52 decreases.

More specifically, in the exemplary embodiment, as described above, before the sheet 50 comes out of the discharge roll 52, the discharge roll 52 stops moving temporarily. Immediately before the discharge roll 52 stops moving, the moving speed of the discharge roll 52 decreases.

Accordingly, when the sheet 50 comes out of the discharge roll 52, the shaking (rattling) of the sheet 50 decreases, and the posture of the sheet 50 is prevented from being disturbed. When the discharge roll 52 suddenly stops moving while moving at a high moving speed, the discharge roll 52 shakes immediately after the stop, thereby causing the shaking (rattling) of the sheet 50. As in the exemplary embodiment, when the moving speed of the discharge roll 52 decreases, the shaking of the sheet 50 decreases, and the posture of the sheet 50 is unlikely to become disturbed.

In the exemplary embodiment, while the push-out member 75 makes one rotation, it is necessary to move the discharge roll 52 by a predetermined amount (a predetermined amount of offset). For this reason, when the rear half portion of the first cam surface B1 is set to have a small inclined angle, it is necessary to set the inclined angle of a first half portion of the first cam surface B1 to be large. At this time, as illustrated in FIG. 8B, the moving speed of the discharge roll 52 increases in the first half portion. In other words, an initial moving speed of the discharge roll 52 at the start of moving is large. In contrast, as described above, immediately before the discharge roll 52 stops, the moving speed of the discharge roll 52 decreases.

Others

In the description above, the image forming apparatus 100 using a so-called electrophotography is exemplified, but each of the above-mentioned configurations described above may be applied to an image forming apparatus using other methods such as an ink jet head method.

In the exemplary embodiment, the image forming apparatus 100 is described as an example, but the application of the above-mentioned configurations is not limited to the image forming apparatus 100. Each of the configurations may be applied to a sheet transporting device that offsets and transports the sheet 50.

The image forming apparatus 100 as an example which is provided with only one of the photosensitive drums 11 and forms a monochromatic image is described above. However, the present invention may be applied to the image forming apparatus 100 that forms a color image, for example, a so-called tandem image forming apparatus in which plural photosensitive drums 11 are disposed in parallel.

In the description above, the motion of the push-out member 75 is switched between a rotation and a stop by using the coaxial member 80 (the missing tooth gear portion 81) and the solenoid 90. However, the motion of the push-out member 75 may be switched between a rotation and a stop by using an electromagnetic clutch, a torque limiter, and the like.

In the description above, the discharge roll 52 moves in the axial direction (a reciprocating motion of the discharge roll 52) due to the push-out member 75 and the coil spring 54 for a roll. However, the push-out member 75 illustrated in FIG. 9 (a view illustrating another configuration example of the push-out member 75) may be used.

Figure 9:
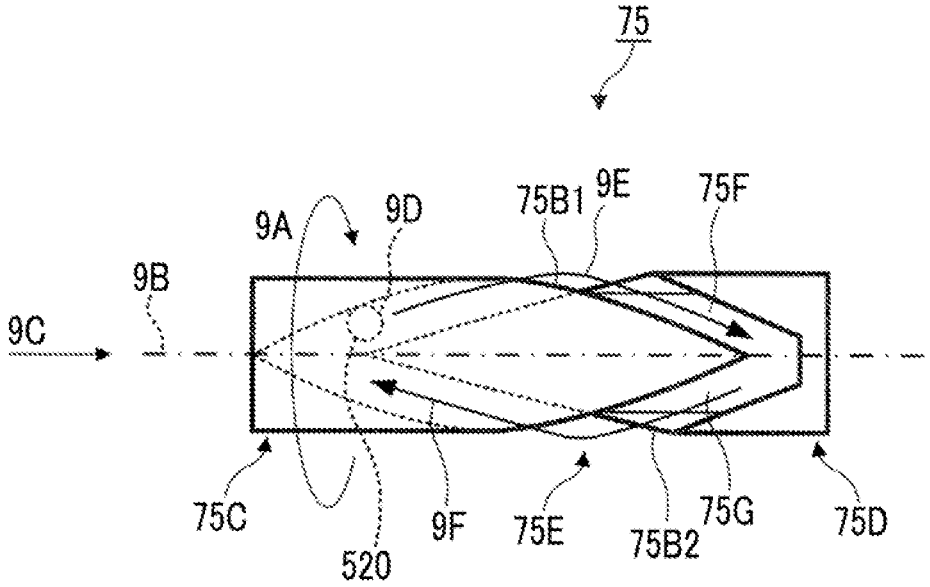
FIG. 9 is a view illustrating another configuration example of the push-out member.

The push-out member 75 rotates about a rotating shaft illustrated by dotted line 9B in a direction illustrated by arrow 9A in FIG. 9. The push-out member 75 includes a first push-out member 75C and a second push-out member 75D.

The first push-out member 75C and the second push-out member 75D are disposed in a line in the axial direction, and a gap 75E is formed between the first push-out member 75C and the second push-out member 75D. A linkage portion 520 is disposed in the gap 75E, and is linked with the discharge roll 52. Here, the gap 75E includes a first helical portion 75F from the left to the right in FIG. 9, and similarly, a second helical portion 75G from the left to the right in FIG. 9.

Here, the first helical portion 75F forms a helical shape in a clockwise direction when advancing from the left to the right in FIG. 9. In other words, when seen from arrow 9C in FIG. 9, the first helical portion 75F advances while forming a helical shape in the clockwise direction. More specifically, the first helical portion 75F has a helical shape wound in the rightward direction.

In contrast, the second helical portion 75G forms a helical shape in a counter-clockwise direction when advancing from the left to the right in FIG. 9. In other words, the second helical portion 75G has a helical shape wound in the leftward direction.

The first helical portion 75F and the second helical portion 75G are formed so as not to intersect each other.

A helical cam surface (cam) 75B1 is provided in the first push-out member 75C at a location facing the first helical portion 75F. Similar to the first helical portion 75F, the cam surface 75B1 advances from the left to the right in FIG. 9 while forming a clockwise helical shape. A helical cam surface (cam) 75B2 is provided in the second push-out member 75D at a location facing the second helical portion 75G. Similar to the second helical portion 75G, the cam surface 75B2 advances from the left to the right in FIG. 9 while forming a counter-clockwise helical shape.

Here, for example, when the push-out member 75 starts rotating while the linkage portion 520 is positioned at a location illustrated by a reference sign 9D, the linkage portion 520 is pushed out by the cam surface 75B1 provided in the first push-out member 75C, and the linkage portion 520 moves in a direction illustrated by arrow 9E in FIG. 9, and thus the discharge roll 52 also moves. When the cam surface 75B1 of the first push-out member 75C finishes pushing out the linkage portion 520, the cam surface 75B2 of the second push-out member 75D moves the linkage portion 520 in a direction illustrated by arrow 9F in FIG. 9, and thus the discharge roll 52 also moves.

In the example illustrated in FIG. 9, the coil spring 54 for a roll is not provided, and a unidirectional rotation of the push-out member 75 causes the reciprocating motion of the discharge roll 52.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material transporting apparatus comprising:

a transport member that transports a recording material in a transport direction;

a linkage portion that moves in an intersection direction in connection with movement of the transport member in the direction intersecting the transport direction;

a rotating member that rotates about a rotating shaft disposed along the intersection direction, that includes a helical cam on a circumference of the rotating shaft, and that presses the linkage portion via the cam to move the linkage portion and the transport member in the intersection direction, wherein a surface at a circumference of the helical cam is provided with a first cam surface having a helical shape, and a second cam surface that is not helical-shaped and is formed along the circumference of the helical cam and along a plane orthogonal to the rotating shaft, the second cam surface being configured to make contact with a sheet guide member, and wherein a common driving source supplies a driving force that the transport member uses to transport the recording material, and a driving force for rotating the rotating member;

a coaxial member having a flapper contact portion that is disposed coaxially with the rotating member and rotates the rotating member;

a solenoid having a flapper and regulating the rotation of the coaxial member, the flapper contact portion having contact with the flapper; and a spring imparting a rotating force to the coaxial member, wherein when the spring imparts a rotating force to the coaxial member, the solenoid is turned on, and the flapper separates from the flapper contact portion, and the coaxial member rotates.

2. The recording material transporting apparatus according to claim 1, wherein when a curved line connecting helically formed end portions on a downstream side of an outer circumferential surface of the cam in the intersection direction is seen in the intersection direction, a non-formation region exists in which the curved line is not formed in a circumferential direction of the rotating member.

3. The recording material transporting apparatus according to claim 2, wherein the cam is formed only on an upstream side of the non-formation region in the intersection direction, and when the linkage portion reaches the non-formation region, the transport member moves in an opposite direction of the intersection direction.

4. The recording material transporting apparatus according to claim 3, further comprising:

a biasing unit that biases the transport member in the opposite direction of the intersection direction.

5. The recording material transporting apparatus according to claim 2, wherein first, a driving force from the driving source is transmitted to a driving force reception portion attached to the transport member, and then is transmitted from the driving force reception portion to the rotating member.

6. The recording material transporting apparatus according to claim 3, wherein first, a driving force from the driving source is transmitted to a driving force reception portion attached to the transport member, and then is transmitted from the driving force reception portion to the rotating member.

7. The recording material transporting apparatus according to claim 4, wherein first, a driving force from the driving source is transmitted to a driving force reception portion attached to the transport member, and then is transmitted from the driving force reception portion to the rotating member.

8. The recording material transporting apparatus according to claim 1, wherein the helical cam has both a helical shape wound in a rightward direction and a helical shape wound in a leftward direction.

9. The recording material transporting apparatus according to claim 8, wherein the helical shape wound in the rightward direction and the helical shape wound in the leftward direction do not intersect each other.

10. The recording material transporting apparatus according to claim 8, further comprising:

a biasing unit that biases the transport member in the opposite direction of the intersection direction.

11. The recording material transporting apparatus according to claim 9, further comprising:

a biasing unit that biases the transport member in the opposite direction of the intersection direction.

12. The recording material transporting apparatus according to claim 8, wherein first, a driving force from the driving source is transmitted to a driving force reception portion attached to the transport member, and then is transmitted from the driving force reception portion to the rotating member.

13. The recording material transporting apparatus according to claim 9, wherein first, a driving force from the driving source is transmitted to a driving force reception portion attached to the transport member, and then is transmitted from the driving force reception portion to the rotating member.

14. The recording material transporting apparatus according to claim 1, wherein first, a driving force from the driving source is transmitted to a driving force reception portion attached to the transport member, and then is transmitted from the driving force reception portion to the rotating member.

15. The recording material transporting apparatus according to claim 14, wherein a length of the driving force reception portion in the intersection direction is greater than a distance by which the transport member moves in the intersection direction.

16. The recording material transporting apparatus according to claim 14, further comprising:

a shutoff unit that shuts off transmission of a driving force from the driving force reception portion to the rotating member.

17. The recording material transporting apparatus according to claim 16, wherein when the linkage portion reaches the non-formation region, the shutoff unit shuts off the transmission of a driving force to the rotating member.

18. The recording material transporting apparatus according to claim 16, further comprising:

a missing tooth gear that includes a gear portion with teeth and a missing tooth portion without teeth formed on an outer circumferential surface of the missing tooth gear, and that rotates in connection with the rotating member, wherein when the missing tooth portion of the missing tooth gear confronts a transmission gear that transmits a driving force to the missing tooth gear and contact between the missing tooth gear and the transmission gear is released, the shutoff unit shuts off the transmission of the driving force.

19. The recording material transporting apparatus according to claims 1, wherein the transport member extends along one direction, and wherein the rotating member is disposed in such a manner that the rotating shaft is parallel with the one direction.

20. An image forming apparatus comprising:

an image forming unit that forms an image on a recording material;

a transport member that transports the recording material, on which the image is formed by the image forming unit, in a transport direction;

a linkage portion that moves in an intersection direction in connection with movement of the transport member in a direction intersecting the transport direction;

a rotating member that rotates about a rotating shaft disposed along the intersection direction, that includes a helical cam on a circumference of the rotating shaft, and that presses the linkage portion via the cam to move the linkage portion and the transport member in the intersection direction, wherein a surface at a circumference of the helical cam is provided with a first cam surface having a helical shape, and a second cam surface that is not helical-shaped and is formed along the circumference of the helical cam and along a plane orthogonal to the rotating shaft, the second cam surface being configured to make contact with a sheet guide member, and wherein a common driving source supplies a driving force that the transport member uses to transport the recording material, and a driving force for rotating the rotating member;

a coaxial member having a flapper contact portion that is disposed coaxially with the rotating member and rotates the rotating member;

a solenoid having a flapper and regulating the rotation of the coaxial member, the flapper contact portion having contact with the flapper; and a spring imparting a rotating force to the coaxial member, wherein when the spring imparts a rotating force to the coaxial member, the solenoid is turned on, and the flapper separates from the flapper contact portion, and the coaxial member rotates.

* * * * *